US010753034B2

(12) United States Patent
Dolbeare

(10) Patent No.: US 10,753,034 B2
(45) Date of Patent: Aug. 25, 2020

(54) DRYER FILTER CLEANING APPARATUS AND METHOD OF USE

(71) Applicant: Charles M. Dolbeare, Lenexa, KS (US)

(72) Inventor: Charles M. Dolbeare, Lenexa, KS (US)

( * ) Notice: Subject to any disclaimer, the term of this patent is extended or adjusted under 35 U.S.C. 154(b) by 33 days.

(21) Appl. No.: 16/257,182

(22) Filed: Jan. 25, 2019

(65) Prior Publication Data

US 2019/0234004 A1 Aug. 1, 2019

Related U.S. Application Data

(60) Provisional application No. 62/622,504, filed on Jan. 26, 2018.

(51) Int. Cl.
*D06F 58/22* (2006.01)

(52) U.S. Cl.
CPC ..... *D06F 58/22* (2013.01)

(58) Field of Classification Search
CPC ..... D06F 58/22; D06F 58/00; D06F 57/00; D06F 2058/2019; D06F 2058/2883; D06F 2058/2803
USPC ..... 34/82
See application file for complete search history.

(56) References Cited

U.S. PATENT DOCUMENTS 3,959,891 A * 6/1976 Burkall ..... D06F 58/22 34/82
3,960,081 A * 6/1976 Gustays ..... B41F 23/0409 101/424.1
4,653,200 A * 3/1987 Werner ..... D06F 58/22
5,052,127 A * 10/1991 Blake ..... D06F 58/22 34/82
5,062,219 A * 11/1991 Harris ..... D06F 58/02 34/242
5,236,478 A * 8/1993 Lewis ..... B01D 46/0006 34/82
5,369,892 A * 12/1994 Dhaemers ..... D06F 58/10 34/224
5,560,075 A * 10/1996 Jankowski ..... A47L 5/365 15/327.2
5,664,339 A * 9/1997 Swanson ..... D06F 58/22
7,213,349 B1 * 5/2007 Brunner ..... D06F 58/20
7,987,615 B2 * 8/2011 Han ..... F24F 7/025 34/595
8,468,711 B2 * 6/2013 Kim ..... D06F 58/22
9,187,860 B2 * 11/2015 Masters ..... D06F 58/20
(Continued)

FOREIGN PATENT DOCUMENTS

DE 112009001012 B4 * 7/2017 ..... D06F 58/22
EP 3135804 A1 * 3/2017 ..... D06F 58/22
(Continued)

*Primary Examiner* — Stephen M Gravini
(74) *Attorney, Agent, or Firm* — Law Office of Mark Brown, LLC; Christopher M. DeBacker

(57) ABSTRACT

A clothes dryer filter cleaning apparatus which has a top opening for receiving the dryer filter. The opening includes a pair of rubber flaps which help to prevent dust and lint from escaping the cleaning apparatus. The filter then passes through several sets of flexible cleaning fingers. The dryer filter is then pulled back out of the opening, pulling the screen of the filter back past the cleaning fingers. The manual function can be replaced or enhanced with a pair of motorized fingers on axles.

13 Claims, 10 Drawing Sheets

(56) References Cited

U.S. PATENT DOCUMENTS

| | | | | |
|---|---|---|---|---|
| 9,896,797 | B2 * | 2/2018 | Shin | D06F 58/22 |
| 10,280,552 | B2 * | 5/2019 | Kulkarni | D06F 58/22 |
| 2002/0023368 | A1 * | 2/2002 | Beaumont | D06F 58/30<br>34/79 |
| 2003/0154618 | A1 * | 8/2003 | Treu | D06F 58/22<br>34/85 |
| 2005/0066638 | A1 * | 3/2005 | Griffiths | A47L 9/127<br>55/482 |
| 2007/0169368 | A1 * | 7/2007 | Kim | D06F 58/22<br>34/82 |
| 2012/0210598 | A1 * | 8/2012 | Hastings | D06F 58/06<br>34/572 |
| 2013/0186811 | A1 * | 7/2013 | Kaiser | E03F 5/0404<br>210/163 |
| 2019/0234004 | A1 * | 8/2019 | Dolbeare | D06F 58/22 |

FOREIGN PATENT DOCUMENTS

| | | | | |
|---|---|---|---|---|
| EP | 3138952 | A1 * | 3/2017 | D06F 58/24 |
| EP | 3135804 | B1 * | 1/2019 | D04F 58/22 |
| EP | 3132082 | B1 * | 8/2019 | D06F 58/02 |
| JP | 6328845 | B2 * | 5/2018 | D06F 58/02 |
| WO | WO-2017206231 | A1 * | 12/2017 | D06F 58/22 |

* cited by examiner

DRYER FILTER CLEANING APPARATUS AND METHOD OF USE

CROSS-REFERENCE TO RELATED APPLICATION

This application claims priority in U.S. Provisional Patent Application No. 62/622,504 Filed Jan. 26, 2018, which is incorporated herein by reference.

BACKGROUND OF THE INVENTION

1. Field of the Invention

The present invention relates generally to a dryer filter cleaning apparatus and method for use thereof, and more specifically to a self-contained dryer filter cleaner for mounting in proximity to a clothing dryer.

2. Description of the Related Art

All clothes dryers contain filters for catching lint, dust, hair, and other debris from clothing when the clothing is being dried. In most commercial variants, this filter must be removed and cleaned between every use of the dryer to prevent fire hazards and to ensure proper airflow through the dryer for the clothing to become dry. Persons with dry hands and skin find the process irritating. Cleaning these filters can be difficult for persons with arthritis or other ailments. Regardless, cleaning the filter often leads to dust and debris dirtying up the floor and the room where the dryer is stored. Using compressed air or other similar solutions only exacerbates this issue by causing the dust and debris to be thrown about the room.

Brushes have also been used, but this adds additional steps for lint removal from the filter, requires the brush to be cleaned, and can cause airborne dust and debris as well.

Heretofore there has not been available a system or method for a dryer filter cleaner with the advantages and features of the present invention.

BRIEF SUMMARY OF THE INVENTION

The present invention generally provides a clothes dryer filter cleaning apparatus which has a top opening for receiving the dryer filter. The opening includes a pair of rubber flaps which help to prevent dust and lint from escaping the cleaning apparatus. The filter then passes through several sets of flexible cleaning fingers. The dryer filter is then pulled back out of the opening, pulling the screen of the filter back past the cleaning fingers. This process thoroughly removes all dust, lint, and other debris from the dryer filter and contains it within the cleaning apparatus or a bag or container connected to the bottom opening of the apparatus.

The typical process of cleaning a filter requires several steps and require contact with the lint. (1) remove the filter from the dryer; (2) remove the majority of lint from the filter; (3) pick the lint from the edges of the filter; (4) dispose of the lint (e.g. in a trash can); (5) re-insert the lint into the dryer. Dust and debris will also require vacuuming or otherwise being cleaned from the area around the waste basket and dryer after the lint is removed. The present invention requires few steps with no human contact with the lint. (1) remove the filter; (2) insert the filter into the filter cleaning apparatus; (3) remove the filer from the filter cleaning apparatus; (4) replace the filter into the dryer.

An embodiment of the invention could replace or add additional fingers powered by an electric motor. This allows even fewer steps to clean the apparatus and even less effort on the part of the user. The fingers would automatically spin and clean the filter screen as it is entered into the device and then withdrawn.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
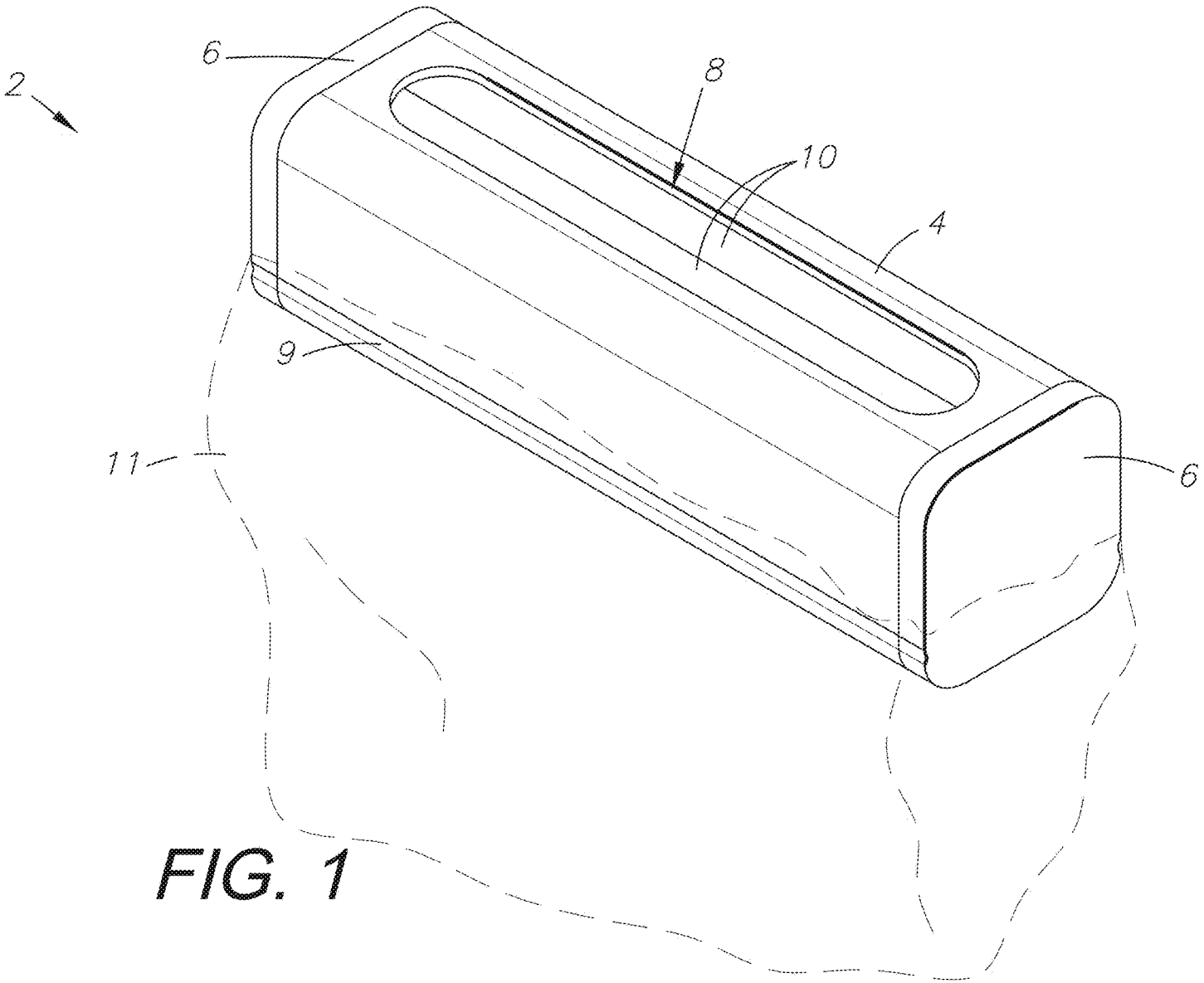
FIG. 1 is a three-dimensional isometric view of a preferred embodiment of the present invention.
Figure 2:
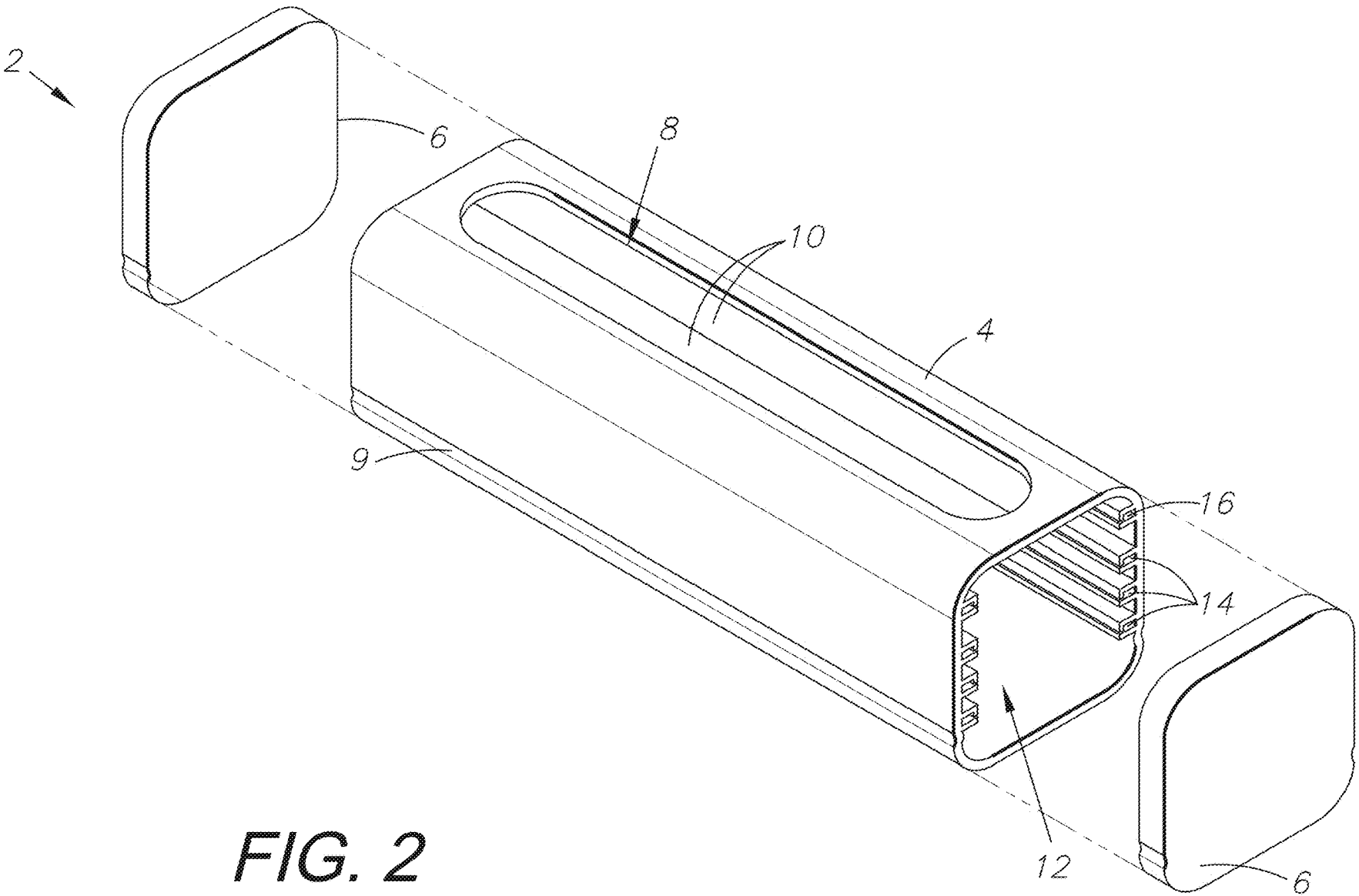
FIG. 2 is a partially exploded three-dimensional isometric view thereof.
Figure 3:
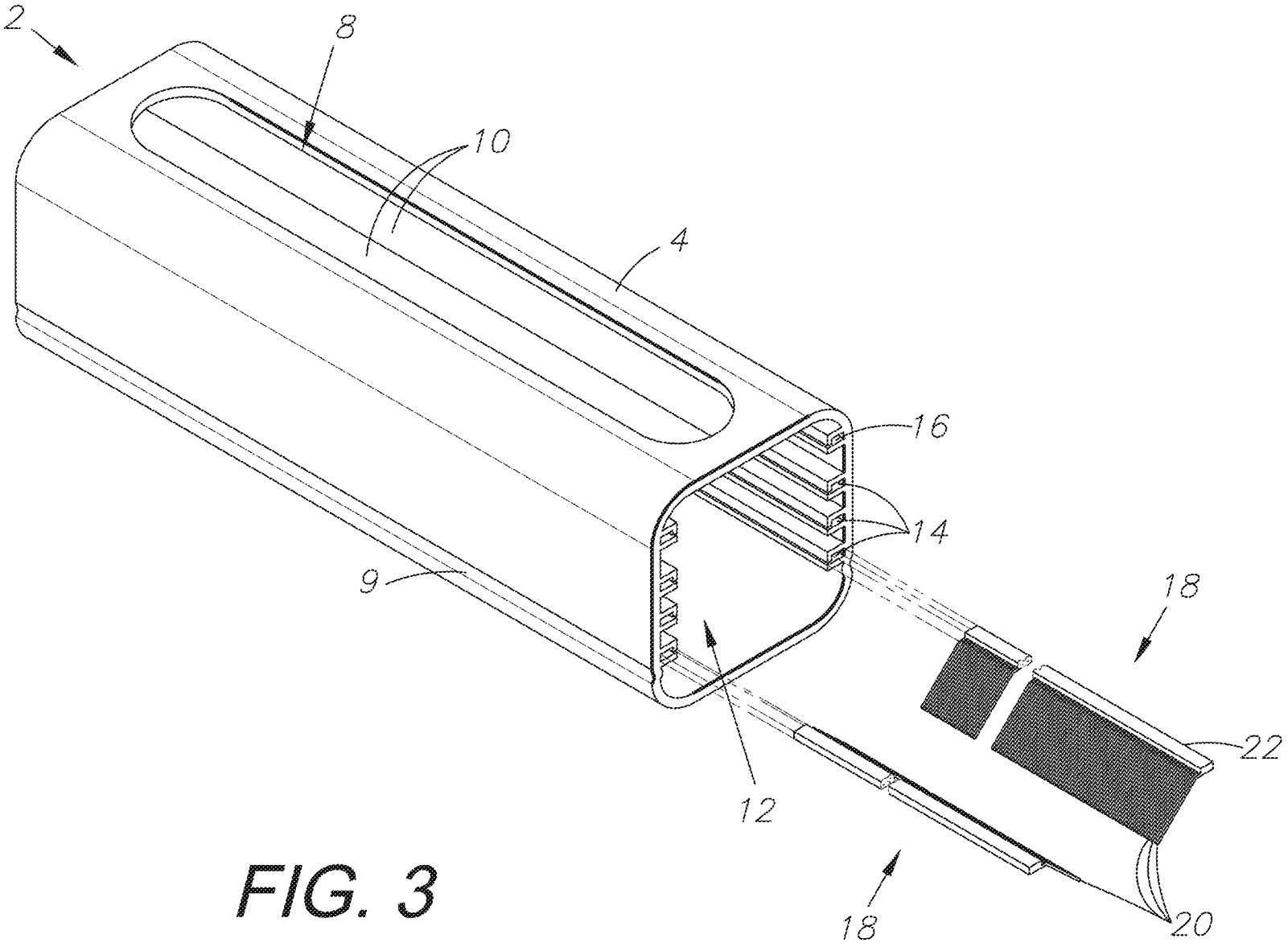
FIG. 3 is another partially exploded three-dimensional isometric view thereof.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Clothes Dryer Filter Cleaner 2

As shown in the FIGS. 1-10, the present invention is a cleaning apparatus for a clothes dryer filter 28 screen 30. The apparatus is primarily made up of a main body 4, a pair of end caps 6, an entrance 8 and exit 26. This allows the filter to be slid into the apparatus to be cleaned, and for the lint, dust, and debris that is cleaned from the filter to exit the apparatus in the exit 26 slot and fall into a standard bag 11 or other disposal unit. The bag 11 can connect to the base of the main body 4 about the bottom portion of the device, either by tightening about a receiver notch 9 or using a clip or other means. A pair of flexible flaps 10 cover the entrance and prevent the lint and other debris from exiting the apparatus through the entrance 8.

Figure 4:
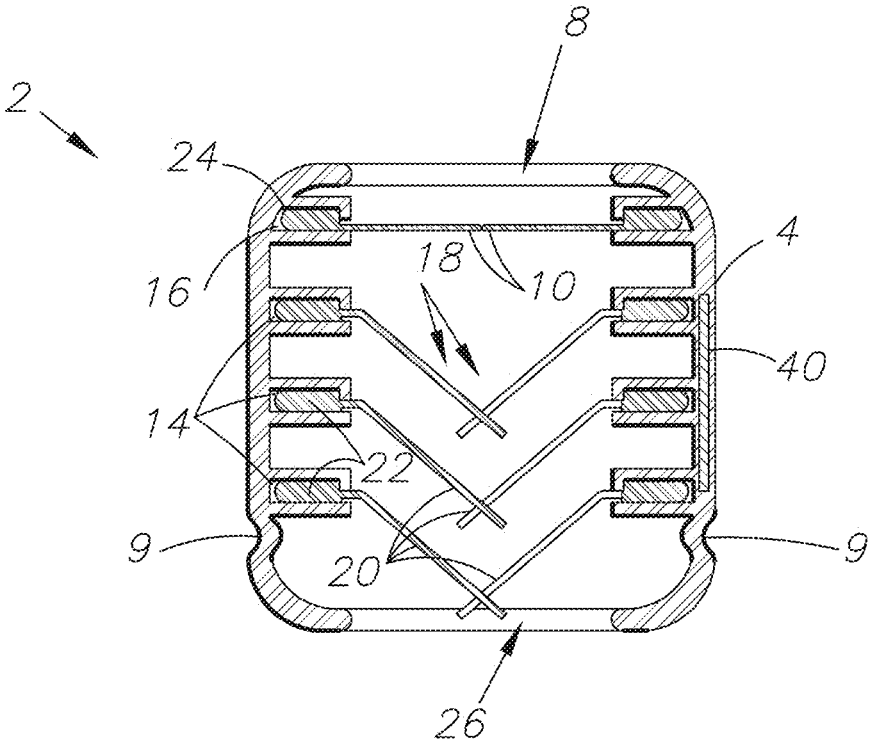
FIG. 4 is a side sectional view thereof taken about the line of FIG. 6.
Figure 5:
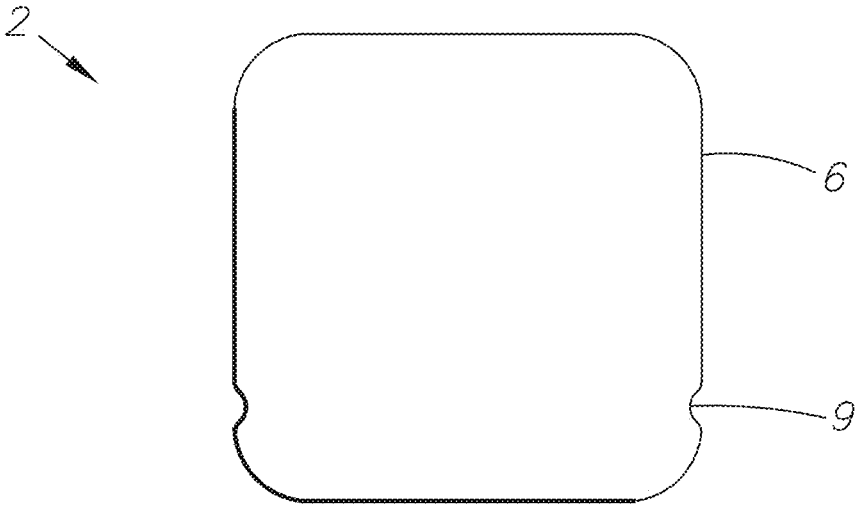
FIG. 5 is a side elevational view thereof.
Figure 6:
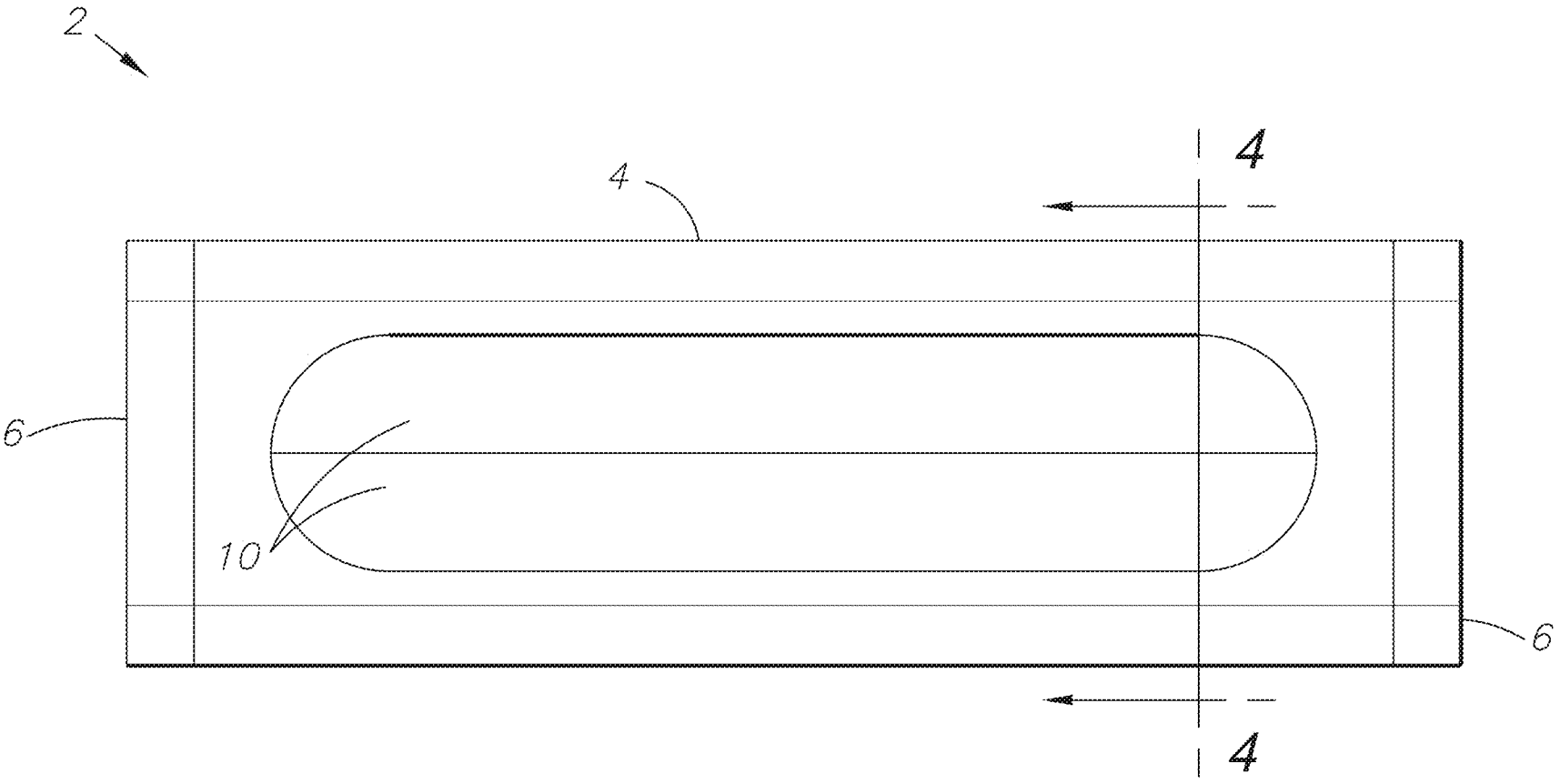
FIG. 6 is a top plan view thereof.
Figure 7:
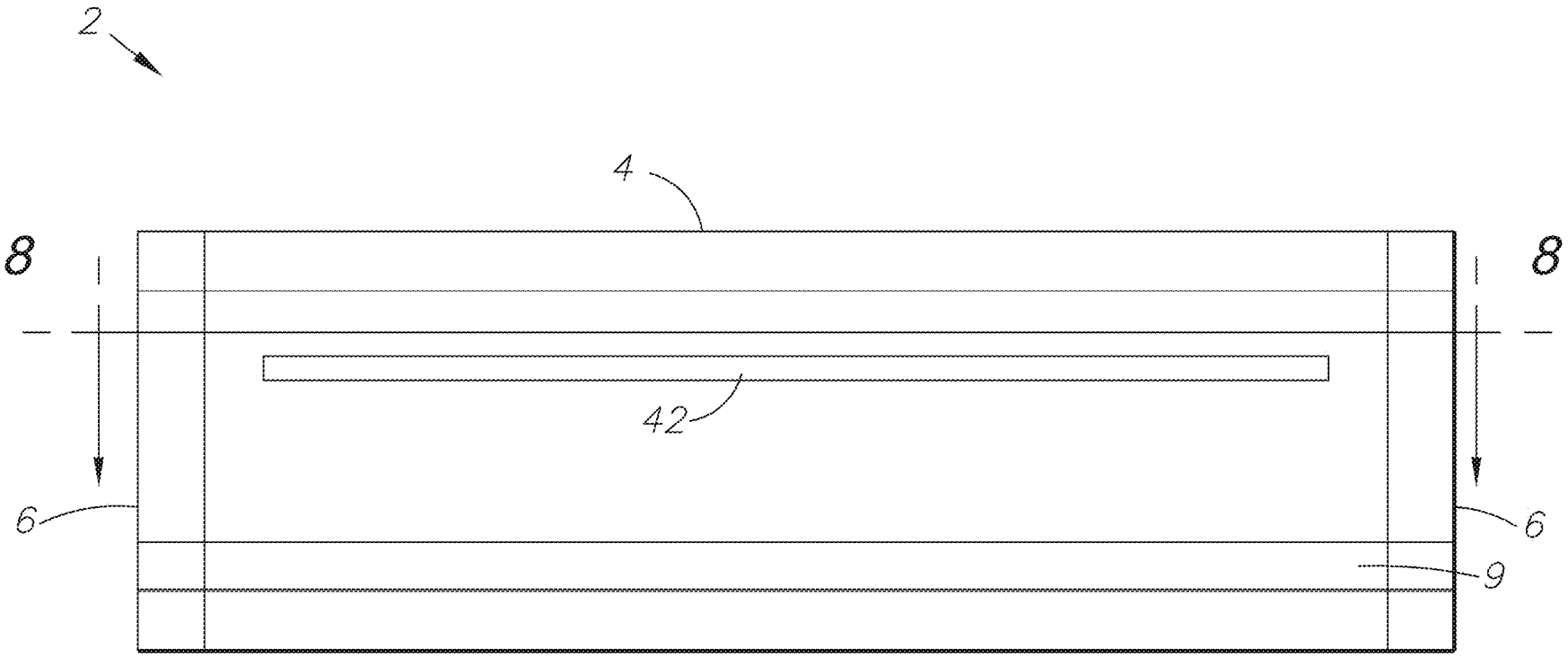
FIG. 7 is a front elevational view thereof.
Figure 8:
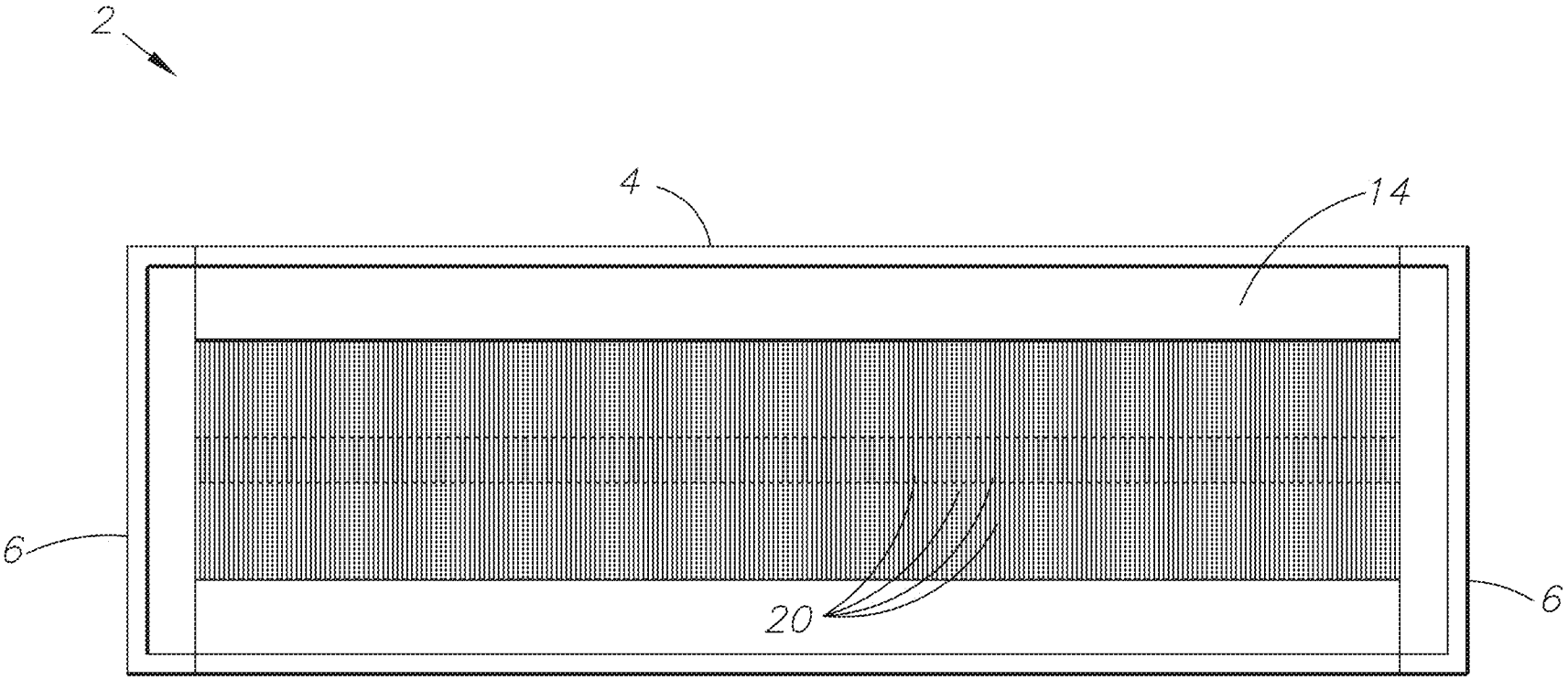
FIG. 8 is a top plan sectional view taken about the line of FIG. 7.
Figure 9:
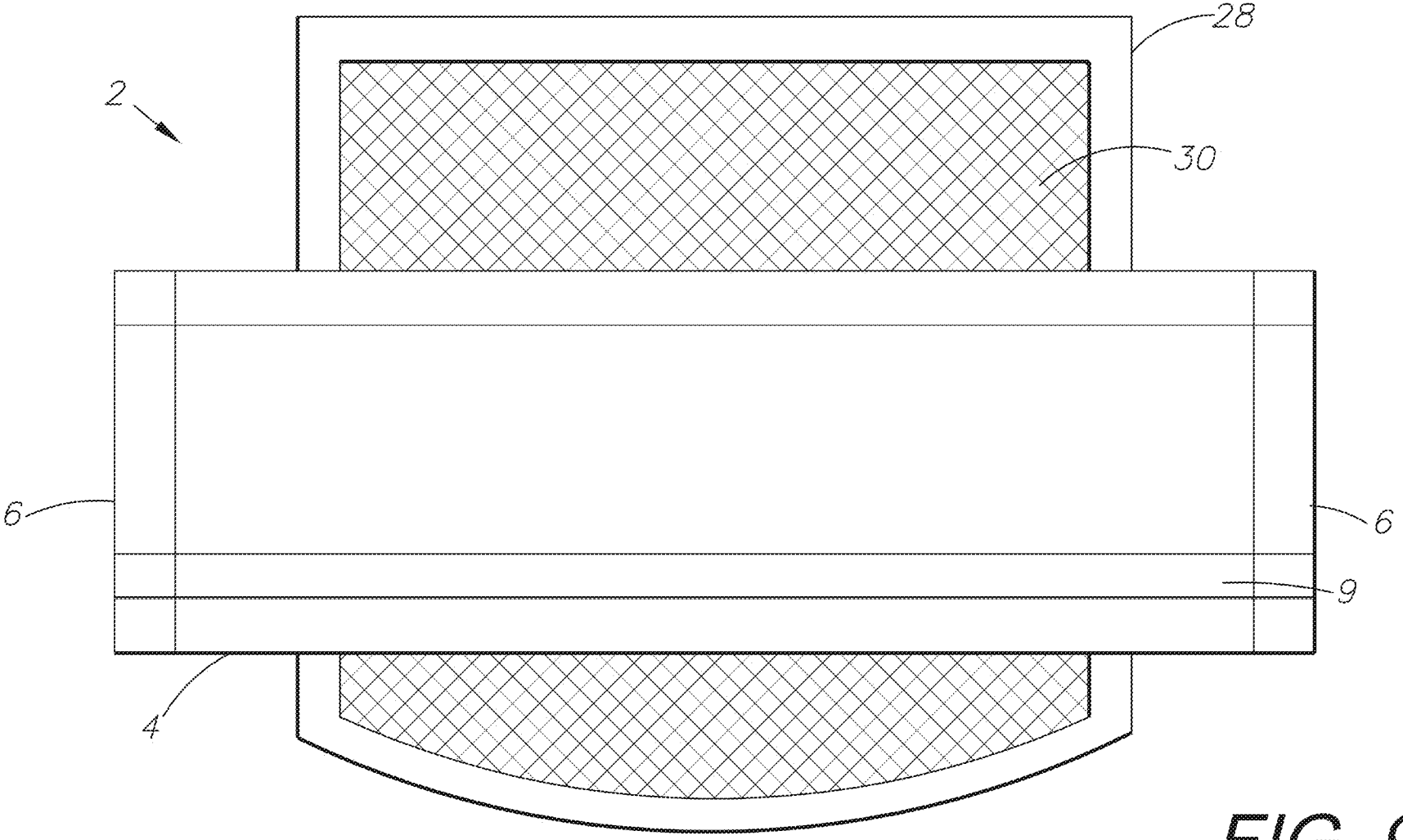
FIG. 9 is a front elevational view thereof showing the present invention used in conjunction with a typical environment dryer filter.
Figure 10:
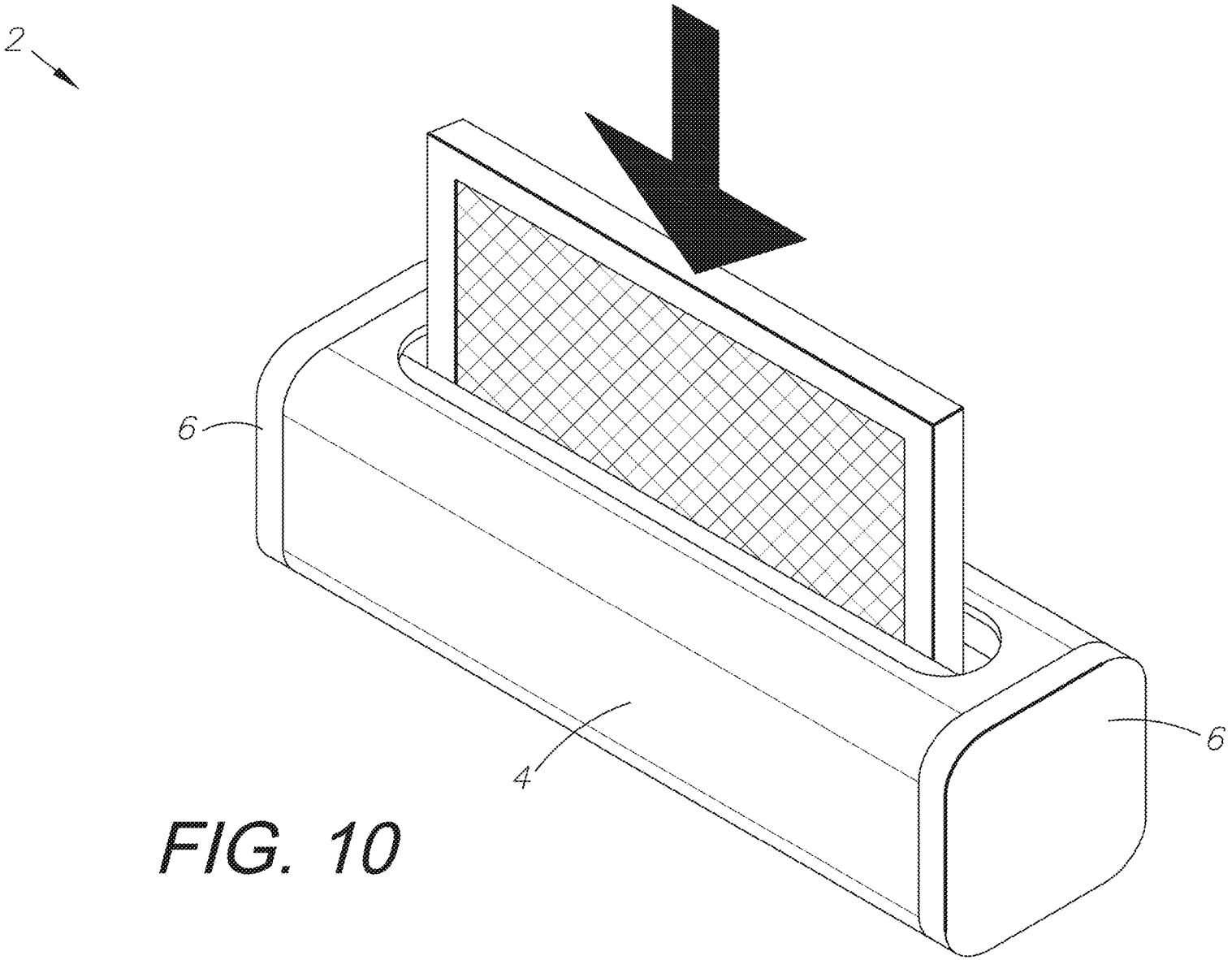
FIG. 10 is a three-dimensional isometric view thereof showing the present invention used in conjunction with a typical environment dryer filter.

Three sets of overlapping fingers 20 are inserted into slotted receivers 14 within the internal space 12 of the main body 4. A slotted insert 22 connecting the fingers 20 of a single set together is slid into a respective slotted receiver 14. As shown in FIG. 4, the fingers 20 overlap slightly and are pushed out of the way when the filter 28 is slid through the embodiment. As shown in FIG. 8, the fingers alternate so as to provide a complete coverage of the screen 30 of the filter 28.

Each set of flexible fingers 20 could be made of different lengths and may be placed at different angles within the main body 4 to ensure that all lint and debris is removed from the filter. For example, the top set of fingers 20 could be placed at ninety degrees (90°, perpendicular to the filter 28. The middle set of fingers 20 could be placed at seventy five degrees (75°, and the bottom set of fingers 20 could be placed at fifty five degrees (55°.

The apparatus can be secured to the side of a commercial clothes drying unit using magnets 40 inserted into a wall of the main body 4 or an adhesive strip 42. Other common means of attachment could also be used, such as screws and nails.

To use, the user removes the lint filter 28 from the dryer, inserts it into the entrance 8 of the apparatus, past the fingers 20, and out of the exit 26 into a bag 11. This action removes some of the debris and lint from the filter. Then the user pulls the filter back out of the opening 8 of the apparatus, causing the fingers 22 to press against the filter and remove the debris, retaining it within the main body 4 and the bag attached to the bag attachment flange 9, cleaning the filter. The flaps 10 over the entrance 8 prevent dust and lint from escaping the apparatus.

The flaps 10 are also received within slotted receivers 16 within the interior 12 of the main body 4. A slotted insert 24 functions in the same way as the slotted insert 22 for the fingers 20.

The end caps 6 can be removed to clean the interior of the device. The fingers 20 and flaps 10 can also be removed by removing their respective slotted inserts 22, 24 from their respective slotted receivers 14, 16 for cleaning.

III. Alternative Embodiment Clothes Dryer Filter Cleaner 52

Figure 11:
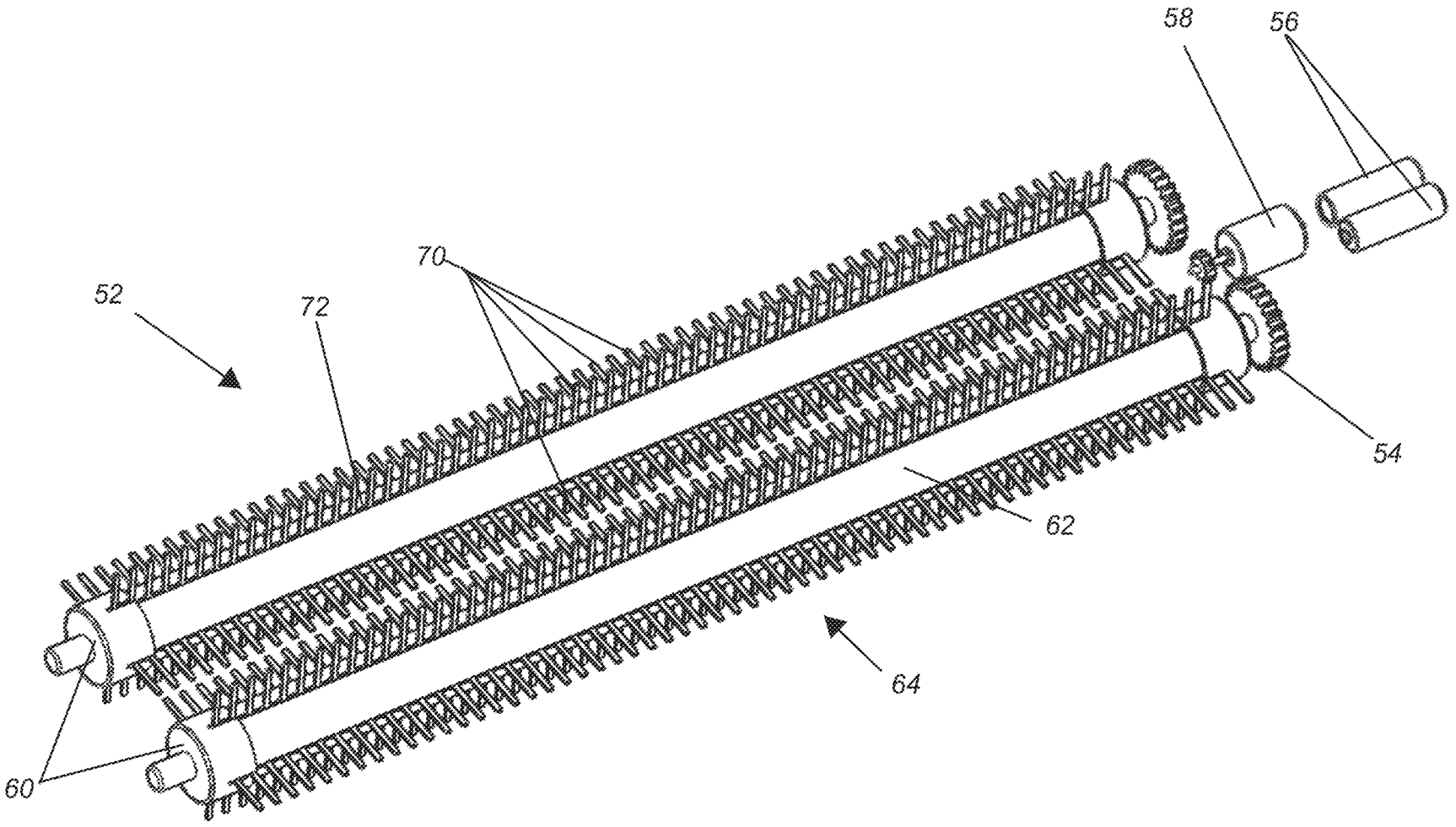
FIG. 11 is a partially exploded three-dimensional isometric view of an alternative embodiment element used in conjunction with the preferred embodiment of the present invention.

FIG. 11 show an alternative embodiment clothes dryer filter cleaner system which adds additional finger slotted inserts 72 with associated fingers 70 and a motor 58 for rotating a gear 54 which drives the fingers 70 to move. In doing so, the dryer lint of an inserted lint screen from a clothes dryer is thoroughly cleaned of lint with minimal manual effort. The finger slotted inserts 72 are received within a fingers clamp 62, and four of such combination of slotted inserts 72 and finger clamps 62 are capped with an axle cap 60 forming a finger assembly 64. This axle cap 60 is then rotatably inserted into the housing 4 of the dryer filter cleaner embodiment disclosed above, or in a suitable alternative housing to allow the motor to spin the entire assembly. A power source 56, such as batteries, powers the electric motor to turn the finger assemblies 74.

It is to be understood that while certain embodiments and/or aspects of the invention have been shown and described, the invention is not limited thereto and encompasses various other embodiments and aspects.

The invention claimed is:

1. A dryer filter cleaning system comprising:

a main body comprising a housing having a pair of side ends each comprising a respective side opening, a top face having a top opening, a front face, a rear face, and a bottom face having a bottom opening;

a pair of end caps each configured to connect to a respective one of said pair of side ends, thereby covering a respective side opening, said end caps being selectively removable from a respective end;

an interior space of said housing contained within said top face, front face, rear face, bottom face, and said pair of end caps;

a pair of flexible flaps placed within said interior space of said housing and configured for covering said top opening;

a first set of flexible fingers affixed to an internal surface of said front face;

a second set of flexible fingers affixed to an internal surface of said rear face;

said first and second sets of flexible fingers being intertwined;

wherein said flexible fingers are configured to clear debris from a dryer filter inserted into said top opening past said pair of flexible flaps; and said bottom opening configured for emptying said debris from said interior space of said housing.

2. The dryer filter cleaning system of claim 1, further comprising:

a third set of flexible fingers affixed to an internal surface of said front face beneath said first set of flexible fingers;

a fourth set of flexible fingers affixed to an internal surface of said rear face beneath said second set of flexible fingers; and said third and fourth sets of flexible fingers being intertwined.

3. The dryer filter cleaning system of claim 2, further comprising:

a fifth set of flexible fingers affixed to an internal surface of said front face beneath said third set of flexible fingers;

a sixth set of flexible fingers affixed to an internal surface of said rear face beneath said fourth set of flexible fingers; and said fifth and sixth sets of flexible fingers being intertwined.

4. The dryer filter cleaning system of claim 1, wherein said first and second sets of fingers are positioned at an angle relative to said dryer filter between perpendicular and 50 degrees.

5. The dryer filter cleaning system of claim 1, further comprising:

a removable bag affixed to said housing and covering said bottom opening; and said removable bag configured to receive said debris from said bottom opening.

6. The dryer filter cleaning system of claim 5, further comprising:

a receiver notch located on said front face and said rear face of said housing;

said receiver notch configured to receive a top opening of said bag; and said bag configured to be retained onto said housing via said receiver notch.

7. The dryer filter cleaning system of claim 5, further comprising:

a clip configured for affixing said bag to said housing.

8. The dryer filter cleaning system of claim 1, further comprising:

a motor connected to a pair of gears;

each one of said gears affixed to a respective one of a pair of finger assemblies, each said finger assembly comprising a plurality of slotted inserts, each slotted insert configured for receiving a set of flexible fingers;

said finger assembly further comprising an axle cap, said axle cap rotatably mounting said finger assembly within said interior of said housing;

said motor configured for turning said gears, thereby turning said finger assemblies; and said flexible fingers configured to clear debris from a dryer filter.

9. The dryer filter cleaning system of claim 1, further comprising:

said first set of flexible fingers comprising a first slotted insert;

said second set of flexible fingers comprising a second slotted insert;

a first slotted receiver configured for removably receiving said first slotted insert;

a second slotted receiver configured for removably receiving said second slotted insert; and wherein said first and second sets of flexible fingers are selectively removable from said housing.

10. The dryer filter cleaning system of claim 9, further comprising:

each of said pair of flexible flaps comprising a slotted insert;

a third and fourth slotted receiver, each of said third and fourth slotted receivers configured to receive a respective one of said slotted inserts of said pair of flexible flaps; and wherein said pair of flexible flaps are selectively removable from said housing.

11. A method of cleaning a dryer filter, the method comprising the steps:

removing a dryer filter from a clothes dryer;

placing a bottom edge of said dryer filter into a top opening of a dryer filter cleaning apparatus, the dryer filter cleaning apparatus comprising a main body comprising a housing having a pair of side ends each comprising a respective side opening, a top face having a top opening, a front face, a rear face, a bottom face having a bottom opening, and a pair of removable end caps each connected to a respective one of said side ends, thereby covering said respective side openings;

pushing said bottom edge of said dryer filter past a pair of flexible flaps located within said housing;

pushing said bottom edge of said dryer filter past a first set and a second set of flexible fingers, said first set of flexible fingers affixed to an internal surface of said front face, said second set of flexible fingers affixed to an internal surface of said rear face, and wherein said first and second sets of flexible fingers are intertwined;

clearing debris from a screen of said dryer filter with said first and second sets of flexible fingers;

emptying said debris from said bottom opening of said bottom face of said housing;

removing said dryer filter from said dryer filter cleaning apparatus; and placing said dryer filter back into said clothing dryer.

12. The method of claim 11, further comprising the steps:

placing a removable bag about said bottom opening of said dryer filter cleaning apparatus;

retaining said removable bag about said bottom opening of said dryer filter cleaning apparatus; and receiving said debris within said removable bag.

13. The method of claim 11, further comprising the steps:

removing one of said pair of end caps from one of said side ends of said housing;

removing said first set of flexible fingers;

removing said second set of flexible fingers;

removing said pair of flexible flaps;

cleaning said first set of flexible fingers, said second set of flexible fingers, and said pair of flexible flaps;

replacing said first set of flexible fingers, said second set of flexible fingers, and said pair of flexible flaps within said housing; and replacing said one of said pair of end caps.

* * * * *